US010520960B2

(12) United States Patent
Shay

(10) Patent No.: US 10,520,960 B2
(45) Date of Patent: Dec. 31, 2019

(54) NEGATIVE VOLTAGE LINEAR REGULATOR CONTROLLER

(71) Applicant: TEXAS INSTRUMENTS INCORPORATED, Dallas, TX (US)

(72) Inventor: Michael John Shay, Fairview, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 15/430,021

(22) Filed: Feb. 10, 2017

(65) Prior Publication Data

US 2018/0231996 A1 Aug. 16, 2018

(51) Int. Cl.
*G05F 1/46* (2006.01)

(52) U.S. Cl.
CPC ..... *G05F 1/46* (2013.01)

(58) Field of Classification Search
CPC ..... G05F 1/46
See application file for complete search history.

(56) References Cited

U.S. PATENT DOCUMENTS 6,888,340 B1 * 5/2005 Chen ..... H02M 3/07 323/313
2007/0252640 A1 * 11/2007 Lin ..... G11C 5/145 327/541
2014/0312866 A1 * 10/2014 Dobkin ..... G05F 1/575 323/280
2016/0116927 A1 * 4/2016 Chen ..... H02M 1/36 323/280

* cited by examiner

*Primary Examiner* — Jue Zhang
(74) *Attorney, Agent, or Firm* — Lawrence J. Bassuk; Charles A. Brill; Frank D. Ciminio

(57) ABSTRACT

A circuit includes a regulation control circuit. The regulation control circuit includes an error amplifier to generate a control output signal based on an error signal input and a reference input. The regulation control circuit includes a level shifter to receive a negative voltage supplied to a load and to provide a positive error signal to the error signal input of the error amplifier. A driver circuit receives the control output signal from the error amplifier and generates a drive output signal in response to the control output signal. A regulation output circuit regulates the negative voltage supplied to the load in response to the drive output signal from the driver circuit.

21 Claims, 4 Drawing Sheets

NEGATIVE VOLTAGE LINEAR REGULATOR CONTROLLER

TECHNICAL FIELD

This disclosure relates to integrate circuits, and more particularly to a control and drive circuit to mitigate ripple from a switching circuit.

BACKGROUND

Photodiodes are employed to convert received light photons to electrical signals than can be detected by electronic detection circuits. To increase the efficiency of the photodiodes, a reverse bias voltage is applied across the photodiode. An inverting switching regulator is often employed to provide a negative voltage for the reverse bias voltage. Due to cost restrictions, the switching regulator can be integrated onto an analog integrated circuit dedicated to providing the voltage supplies for the system. The substrate of the integrated circuit is grounded. Conventional circuits directly use the output of the inverting switching regulators as the source of negative voltage. However, the ripple generated on the switching regulator output exclude it from being used directly on the anode of the photodiode which can couple noise to other sensing circuits. If noise is coupled though the photo-diode and sensed by a very high-gain transimpedance amplifier (TIA), for example, this can cause detection problems in the circuit.

SUMMARY

This disclosure relates to a control and drive circuit to mitigate ripple from a switching circuit. In one example, a circuit includes a regulation control circuit. The regulation control circuit includes an error amplifier to generate a control output signal based on an error signal input and a reference input. The regulation control circuit includes a level shifter to receive a negative voltage supplied to a load and to provide a positive error signal to the error signal input of the error amplifier. A driver circuit receives the control output signal from the error amplifier and generates a drive output signal in response to the control output signal. A regulation output circuit regulates the negative voltage supplied to the load in response to the drive output signal from the driver circuit.

In another example, a circuit includes an error amplifier to generate a control output signal based on an error signal input and a reference input. A current source generates a current source output signal to drive the error signal input of the error amplifier based on a negative voltage supplied to a load. A feedback circuit is coupled to the current source output signal of the current source. The feedback circuit receives the negative voltage supplied to the load and operates with the current source to provide a level-shifted error signal to the error signal input of the error amplifier. A driver circuit receives the control output signal from the error amplifier and generates a drive output signal in response to the control output signal. A regulation output circuit regulates the negative voltage supplied to the load in response to the drive output signal from the driver circuit.

In yet another example, a method includes generating a control output signal based on an error signal and a reference signal. The method includes shifting the error signal to a positive voltage based on a negative voltage supplied to a load. The method includes generating a drive output signal in response to the control output signal. The method includes regulating the negative voltage supplied to the load based the drive output signal and the shifted error signal.

DETAILED DESCRIPTION

This disclosure relates to a control and drive circuit to mitigate ripple from a switching circuit. The control and drive circuit along with a regulation output circuit provide a negative linear regulator circuit which mitigates switching noise from a switching power supply from reaching a load circuit such as a photodiode, for example. The negative linear regulator circuit converts unregulated negative voltages to positive error and feedback signals which facilitates ground-referred semiconductor implementations for the control and drive circuit which mitigates cost in the circuit. In an example, a drive output signal is provided to an external (or internal) power device (e.g., NFET), where the drive output signal is used as the regulation drive signal for the negative regulator circuit. Voltage feedback sensing can be performed via an integrated error amplifier whose feedback terminal is level-shifted up to a positive voltage generated by forcing a resistor-based current through a feedback network (e.g., resistor network) tied to the generated negative supply of the regulator circuit.

The level-shifted feedback can be compared against a band gap-generated reference which results in the error amplifier output. By providing a positive voltage at the feedback terminal of the error amplifier, various components of the negative regulator circuit can be disposed on a common semiconductor substrate which can be referenced to ground (as opposed to a negative voltage) which simplifies the implementation of the circuit while reducing costs. The error amplifier then drives a driver circuit (e.g., a low gain second stage) element that includes an integrated transistor device (e.g., NMOS device) whose gate is driven by the error amplifier followed by a source degeneration resistor to facilitate stability in the circuit.

A blocking transistor device can be provided to clamp the drive output signal and block negative voltages from reaching the driver circuit. The driver circuit generates a current that is fed through to the drain of the blocking device and is then driven across an external resistance that is also tied to the gate of the external power device. The other terminal of the external resistor is tied to the unregulated negative VIN supply. The source of the external power device can be degenerated (e.g., via a resistor) to lower the gain of the control loop which facilitates loop stability (e.g., increases phase margin) when combined with the dominant pole frequency-based gain roll-off characteristic generated by capacitance at the output of the power device. Soft starting capabilities can be provided where the negative regulator circuit is cycled on and off over a given period to allow output load capacitances to slowly charge and to mitigate large current disruptions to the switching supply which feeds the negative regulator circuit.

Figure 1:
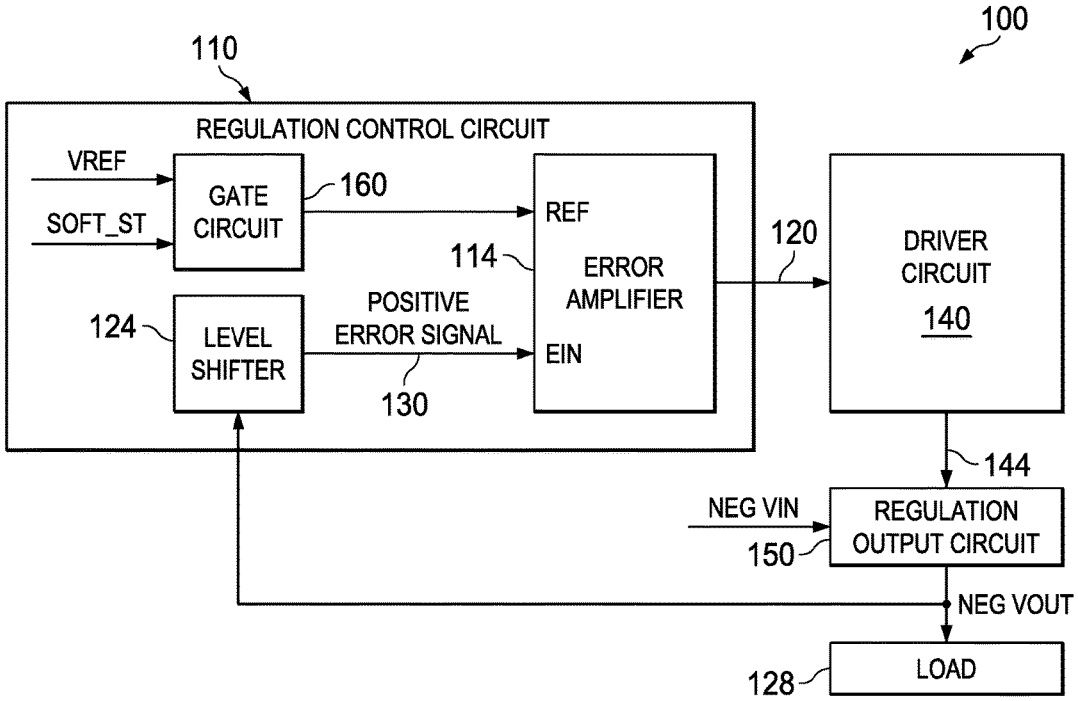
FIG. 1 illustrates an example block diagram of a negative voltage regulator circuit.

FIG. 1 illustrates an example of a negative voltage regulator circuit 100. As used herein, the term "circuit" can include a collection of active and/or passive elements that perform a circuit function, such as an analog circuit or control circuit. Additionally or alternatively, for example, the term "circuit" can include an integrated circuit (IC) where all and/or some of the circuit elements are fabricated on a common substrate (e.g., semiconductor substrate).

As shown, the circuit 100 includes a regulation control circuit 110 that includes an error amplifier 114 to generate a control output signal 120 based on an error signal input (EIN) and a reference input (REF). The regulation control circuit 110 includes a level shifter 124 to receive a negative voltage (NEG VOUT) supplied to a load 128 and to provide a positive error signal 130 to the error signal input EIN of the error amplifier 114. A driver circuit 140 receives the control output signal 120 from the error amplifier 114 and generates a drive output signal 144 in response to the control output signal 120. The regulation control circuit 110 and driver circuit 140 can be operated from a positive supply voltage (e.g., 3.3V chip voltage). A regulation output circuit 140 regulates the negative voltage NEG VOUT supplied to the load 128 in response to the drive output signal 144 from the driver circuit 140 and negative input voltage NEG VIN which can be generated via switching power supply (see e.g., FIG. 3).

In one example, the regulation control circuit 110 and the driver circuit 140 are disposed on an integrated circuit substrate that is referenced to ground and the regulation output circuit 150 is referenced to a negative voltage and operated as an external circuit to the integrated circuit substrate. In other examples, all the circuits described herein can be disposed on a common substrate or implemented as individual circuits that are unbound to a substrate. The level shifter 124 includes a current source (see e.g., FIG. 2) that generates the error output signal 130 to drive the error signal input EIN of the error amplifier 114 based on the feedback from NEG VOUT. The level shifter 124 can also include a resistive network (see e.g., FIG. 2) coupled to the current source output signal of the current source. The resistive network receives the negative voltage NEG VOUT supplied to the load and operates with the current source to provide the level-shifted error signal 130 to the error signal input EIN of the error amplifier 114. The current source in the level shifter 124 can also include an amplifier with a resistive feedback network which is correlated to a resistance of the resistive network to provide the level-shifted error signal 130 and regulate the negative voltage NEG VOUT supplied to the load 128.

The regulation control circuit 110 can include a gate circuit 160 that drives the reference input VREF of the error amplifier 114. The gate circuit 160 receives a reference voltage VREF and a soft start signal SOFT_ST that is switched to control the rate at which the negative voltage is supplied to the load. If SOFT_ST is toggled over a given time period, the circuit 100 can be brought up in a controlled manner which mitigates surges on external switching power supplies that provide the unregulated NEG VIN (see e.g., signal diagram of FIG. 4).

The driver circuit 140 can include a transistor device (see e.g., FIG. 2) to generate the drive output signal 144. The transistor device can include a resistor at a source node of the device to provide degenerative feedback and facilitate stability in the driver circuit. The driver circuit 140 can also include a blocking transistor device (see e.g., FIG. 2) in series with the source node of the transistor device to block negative voltages from reaching the driver circuit. The regulation output circuit 150 can also include a regulation transistor device that regulates the negative voltage NEG VOUT supplied to the load 128 based on the drive output signal 144 from the driver circuit 140 received from a switching regulator. The regulation transistor device can include a degeneration resistor at a source node of the device to provide degenerative feedback and facilitate stability in the regulation output circuit. The regulation output circuit 150 can include a resistor tied between the gate of the regulation transistor and ground (see e.g., FIG. 2). Since the driver circuit 140 provides a current as the feedback control, the resistor (or equivalent) is utilized to generate a suitable gate-to-source voltage on the regulation transistor which generates the regulated negative voltage NEG VOUT supplied to the load 128.

Figure 2:
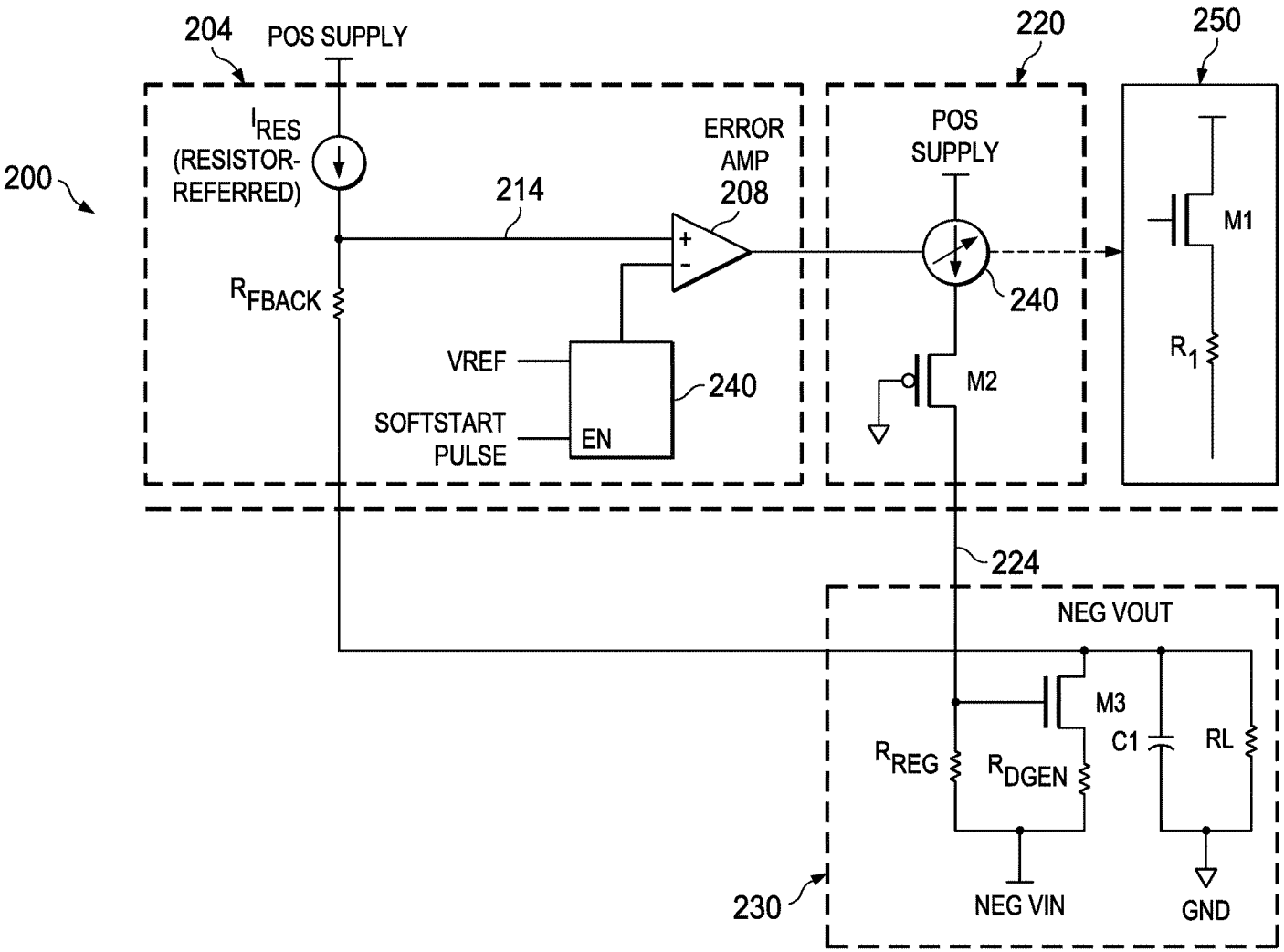
FIG. 2 illustrates an example of a negative voltage regulator circuit.

FIG. 2 illustrates an example of a negative voltage regulator circuit 200. A regulation circuit 204 includes an error amplifier 208 to generate a control output signal 210 based on an error signal input (positive terminal of amplifier) and a reference input (negative terminal of amplifier). A current source IRES receives a positive supply voltage (POS SUPPLY) and generates a current source output signal 214 to drive the error signal input of the error amplifier 208. A feedback circuit RFBACK (e.g., trim-able resistor network) is coupled to the current source output signal of the current source IRES. The feedback circuit RFBACK receives a negative voltage NEG VOUT supplied to a load of C1 and RL and operates with the current source IRES to provide a level-shifted error signal 214 to the error signal input of the error amplifier 208. A driver circuit 220 receives the control output signal 210 from the error amplifier 208 and generates a drive output signal 224 in response to the control output signal. A regulation output circuit 230 regulates the negative voltage NEG VOUT supplied to the load C1/RL in response to the drive output signal 224 from the driver circuit 220.

In one example, the current source IRES, the feedback circuit RFBACK, the error amplifier 208, gate circuit 240, and the driver circuit 220 are disposed on an integrated circuit substrate that is referenced to ground and the regulation output circuit 230 is referenced to a negative voltage and operated as an external circuit to the integrated circuit substrate. As noted previously, non-integrated circuit implementations are also possible. The current source IRES can include an amplifier with a resistive feedback network to generate output current from the source. The resistive feedback can be correlated to a resistance of the feedback circuit to provide the level-shifted error signal 214 and regulate the negative voltage supplied to the load. As used herein, the term correlated refers to defining a ratio of resistances utilized for IRES with respect to the resistances utilized for RFBACK. This can include design ratios (e.g., 10 to 1), where respective resistance can also be trimmed during factory testing. The selection of the resistance values defines the value of NEG VOUT based on a given input range for NEG VIN which can be supplied by a switching power supply. For example, if NEG VIN is set to a range −10V to −14V, the regulated output can be set to −8V (or other value) depending on the resistances.

As shown, the regulation control circuit 204 includes a gate circuit 240 (e.g., analog switch) that drives the reference input of the error amplifier 240. The gate circuit 240 receives a reference voltage VREF and a soft start signal that is switched to control the rate at which the negative voltage is supplied to the load. The driver circuit 220 includes a current source 240 to generate the drive output signal 224.

A cut-away 250 shows an example current source 240 having a transistor device M1 to generate the drive output signal 224. The transistor device M1 includes a resistor R1 at a source node of the device to provide degenerative feedback and facilitate stability in the driver circuit 220. The driver 220 circuit includes a blocking transistor device M2 in series with the source node of the transistor device M1 to block negative voltages from reaching the driver circuit.

The regulation output circuit 230 includes a regulation transistor device M3 that regulates the negative voltage NEG VOUT supplied to the load based on the drive output signal 224 from the driver circuit 220 and a negative input voltage NEG VIN received from a switching regulator. The regulation transistor device M3 includes a degeneration resistor RDGEN at a source node of the device to provide degenerative feedback and facilitate stability in the regulation output circuit 230. The regulation transistor device M3 includes a gate resistor RREG which is used to generate a suitable gate-to-source voltage (VGS) on M3 for creating the regulated negative voltage NEG VOUT. The high output impedance of M3 in parallel with C1 creates a low frequency pole that filters noise coupled through RREG from the NEG VIN source. The amplitude of source noise into the gate of M3 is substantially attenuated relative to the ripple on the unregulated NEG VIN source based on the low pass filter generated by the RC combination of RREG and the gate capacitance of M3. An example gate capacitance of M3 is about 500 pF, for example. Example values for RREG can be about 18K ohms and an example value for RDGEN can be about 160 ohms.

Figure 3:
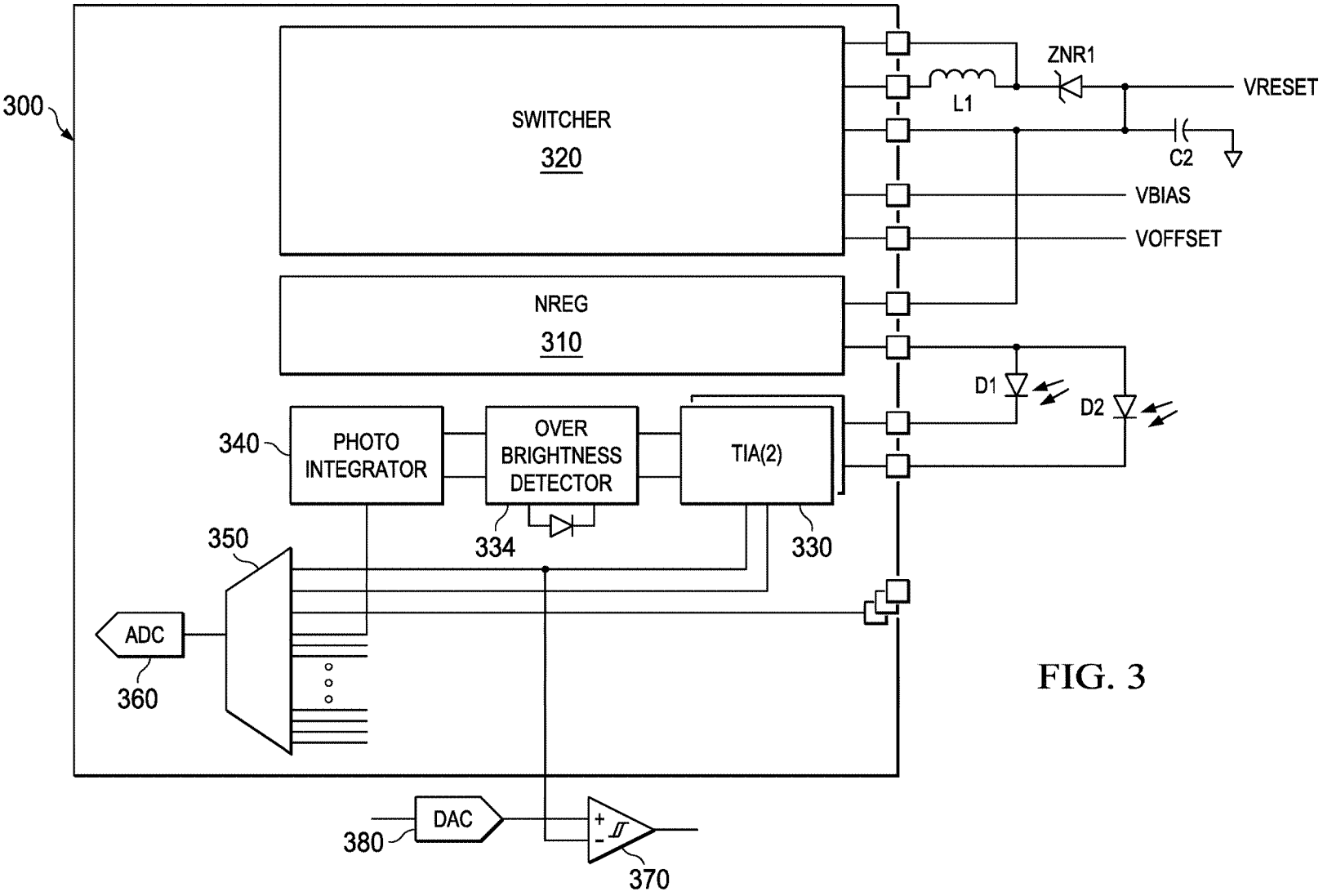
FIG. 3 illustrates an example of an integrated circuit that employs a negative voltage regulator circuit.

FIG. 3 illustrates an example of an integrated circuit 300 that employs a negative voltage regulator circuit 310. The negative regulator circuit can be implemented via the examples illustrated and described above with respect to FIGS. 1 and 2. In this example, a switching supply 320 can provide a negative input voltage to the negative regulator circuit 310. The switching supply 320 can be coupled to external switching components such as L1, C2, and ZNR1, for example. It can also be controlled via input controls shown as VBIAS and VOFFSET. Negative voltage output from the negative voltage regulator circuit 310 can drive one or more photodiodes D1 and D2 which are monitored via transimpedance amplifiers (TIA) 330. Output from TIA 330 can be sampled by an over brightness detector 334 which in turn drives a photo integrator 340. Output from the integrator 340 can be fed to a multiplexor 350 which can be read for brightness values from D1 and D2 via analog to digital converter 360 (ADC). Other circuit functions can also be provided within the circuit 300. A comparator 370 can monitor output from the TIA 330 with respect to a threshold supplied by digital to analog converter (DAC) 380. Output from the comparator 370 can be used as feedback to an LED controller (not shown) if the TIA output exceeds the threshold set by the DAC 380.

Figure 4:
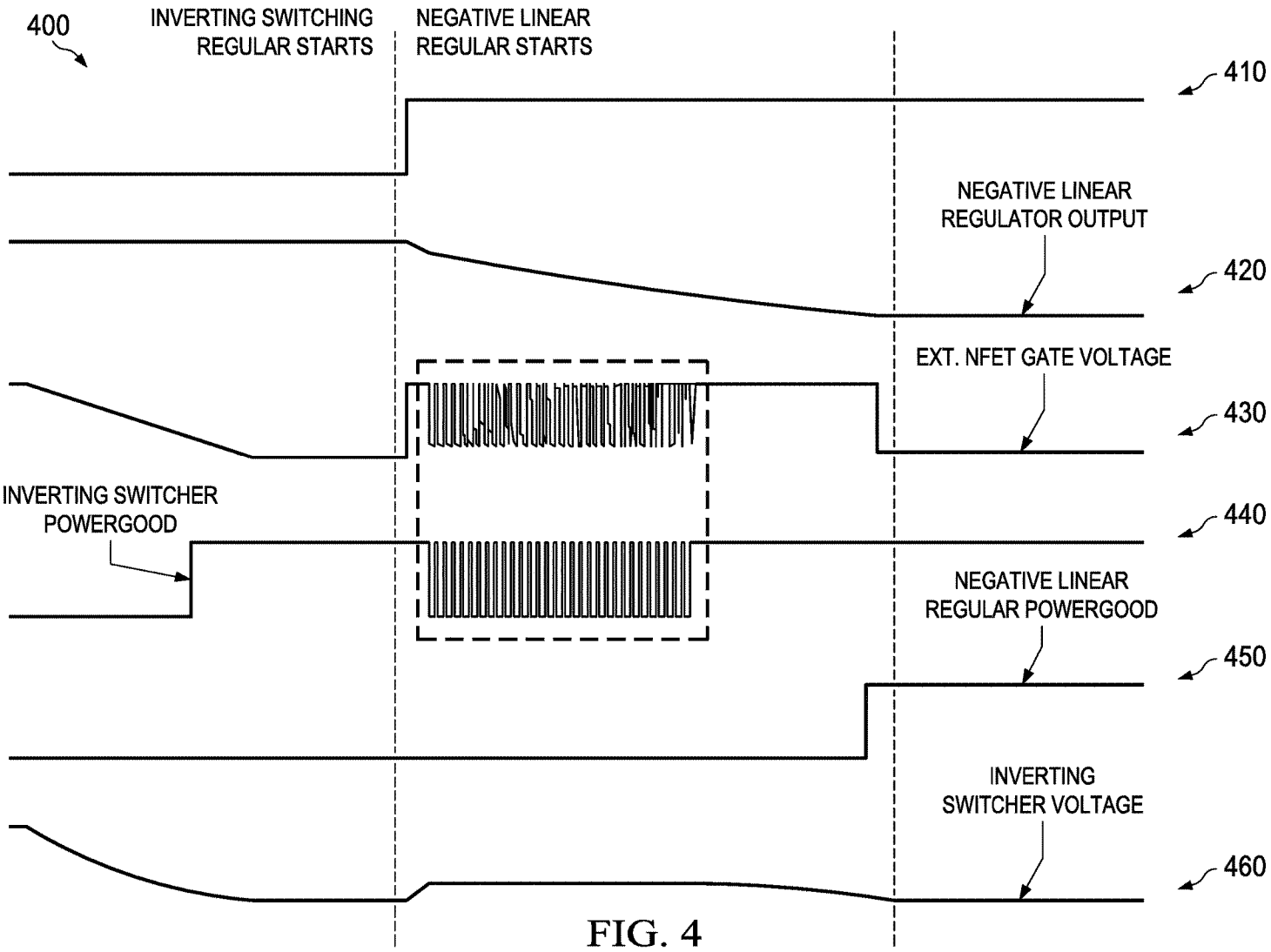
FIG. 4 illustrates an example signal diagram for a negative voltage regulator circuit.

FIG. 4 illustrates an example signal diagram 400 for a negative voltage regulator circuit described herein. A 410, a negative linear regulator output start signal is shown. At 420, negative voltage (NEG VOUT) goes negative in response to the start signal at 410. At 430, the soft switching pulse described herein begins to pulse to control how long it takes for the negative linear regulator circuit to come up to voltage. Soft starting allows the negative linear regulator to come online in a controlled manner without causing a huge current spike on possibly a shutdown of the associated switching supply driving the negative regulator. At 440, a status signal (e.g., inverter power good signal) reacts to the soft starting of the regulator at 430. At 450, status of the negative regulator is set. At 460, output from the switching regulator supplying the negative linear regulator is shown.

Figure 5:
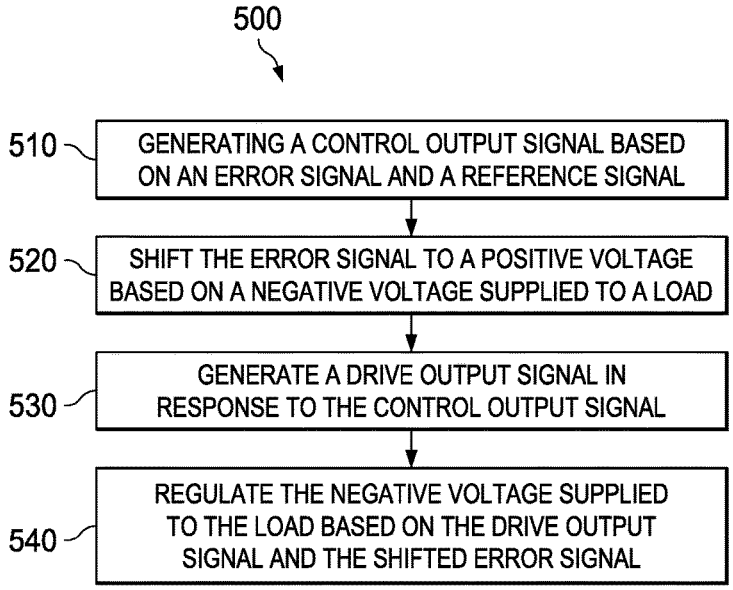
FIG. 5 illustrates an example method to regulate a negative voltage at a load.

In view of the foregoing structural and functional features described above, an example method will be better appreciated with reference to FIG. 5. While, for purposes of simplicity of explanation, the method is shown and described as executing serially, it is to be understood and appreciated that the method is not limited by the illustrated order, as parts of the method could occur in different orders and/or concurrently from that shown and described herein. Such method can be executed by various components configured in an IC or a processor, for example.

FIG. 5 illustrates an example method 500 to regulate a negative voltage at a load. At 510, the method 500 includes generating a control output signal based on an error signal and a reference signal (e.g., via error amplifier 114 of FIG. 1). At 520, the method 500 includes shifting the error signal to a positive voltage based on a negative voltage supplied to a load (e.g., via level shifter 124 of FIG. 1). At 530, the method 500 includes generating a drive output signal in response to the control output signal (e.g., via driver circuit 140 of FIG. 1). At 540, the method 500 includes regulating the negative voltage supplied to the load based the drive output signal and the shifted error signal (e.g., via regulation output circuit 150 of FIG. 1). Although not shown, the method 500 can also include including toggling a soft start signal to control the rate at which the negative voltage is supplied to the load (e.g., via gate circuit 160 of FIG. 1).

What have been described above are examples. It is, of course, not possible to describe every conceivable combination of components or methodologies, but one of ordinary skill in the art will recognize that many further combinations and permutations are possible. Accordingly, the disclosure is intended to embrace all such alterations, modifications, and variations that fall within the scope of this application, including the appended claims. As used herein, the term "includes" means includes but not limited to, the term "including" means including but not limited to. The term "based on" means based at least in part on. Additionally, where the disclosure or claims recite "a," "an," "a first," or "another" element, or the equivalent thereof, it should be interpreted to include one or more than one such element, neither requiring nor excluding two or more such elements.

What is claimed is:

1. A regulation control circuit, comprising:

an error amplifier having a control output, an error input, and a reference input;

a level shifter having a positive supply input, a negative load voltage input, and a positive error output coupled to the error input of the error amplifier;

a driver circuit having a positive supply input, a control input coupled to the control output from the error amplifier, and a drive output; and a regulation output circuit having a negative voltage input, a drive input coupled to the drive output from the driver circuit, and a negative load voltage output coupled to the negative load voltage input, the regulation output circuit including a regulation transistor coupled between the negative load voltage output and the negative input and having a control input coupled to the drive output that regulates a negative load voltage based on the drive output from the driver circuit, and the regulation output circuit includes a resistor coupled between the regulation transistor and the negative voltage input.

2. The circuit of claim 1, in which the regulation control circuit and the driver circuit are disposed on an integrated circuit substrate that is referenced to ground and the regulation output circuit is referenced to a negative voltage and operated as an external circuit to the integrated circuit substrate.

3. The circuit of claim 1, in which the level shifter includes a current source that receives a positive input voltage and generates an error output signal to drive the error signal input of the error amplifier based on the negative voltage supplied to the load.

4. The circuit of claim 3, in which the level shifter includes a resistive network coupled to the current source output signal of the current source, the resistive network receives the negative voltage supplied to the load and operates with the current source to provide a level-shifted error signal to the error signal input of the error amplifier.

5. The circuit of claim 4, in which the current source includes an amplifier with a resistive feedback network which is correlated to a resistance of the resistive network to provide the level-shifted error signal and regulate the negative voltage supplied to the load.

6. The circuit of claim 1, in which the regulation control circuit includes a gate circuit that drives the reference input of the error amplifier, the gate circuit receives a reference voltage and a soft start signal that is switched to control the rate at which the negative voltage is supplied to the load.

7. The circuit of claim 1, in which the driver circuit includes a blocking transistor device to generate the drive output signal, the blocking transistor device includes a resistor at a source node of the device.

8. The circuit of claim 1, in which the regulation transistor device includes a gate resistor to provide biasing and filtering for the gate of the regulation transistor device.

9. A circuit, comprising:

an error amplifier having a control output, an error input, and a reference input;

a current source having a current source output coupled to the error input of the error amplifier;

a feedback circuit having an input coupled to the negative load voltage input and having a level-shifted error output coupled to the error input of the error amplifier;

a driver circuit having an input coupled to the control output from the error amplifier and having a drive output;

a regulation output circuit having a drive input coupled to the drive output, a negative voltage input, and a negative load voltage output coupled to the negative load voltage input, the regulation circuit including a transistor coupled to the drive output, and a resistor at a source node of the transistor.

10. The circuit of claim 9, in which the error amplifier, the current source, and the driver circuit are disposed on an integrated circuit substrate that is referenced to ground and the regulation output circuit is referenced to a negative voltage and operated as an external circuit to the integrated circuit substrate.

11. The circuit of claim 10, in which the current source includes an amplifier with a resistive feedback network which is correlated to a resistance of the feedback circuit to provide the level-shifted error signal and regulate the negative voltage supplied to the load.

12. The circuit of claim 9, in which the regulation control circuit includes a gate circuit that drives the reference input of the error amplifier, the gate circuit receives a reference voltage and a soft start signal that is switched to control the rate at which the negative voltage is supplied to the load.

13. The circuit of claim 9, in which the driver circuit includes a blocking transistor device in series with the source node of the transistor device to block negative voltages from reaching the driver circuit.

14. The circuit of claim 9, in which the regulation output circuit includes a regulation transistor device that regulates the negative voltage supplied to the load based on the drive output signal from the driver circuit, the regulation transistor device includes a resistor at a source node of the device.

15. A circuit, comprising:

(a) a regulation control circuit, including:

an error amplifier having an error input, a reference voltage input, and a control output;

an analog gate circuit having a reference voltage input, a softstart pulse input, and a reference output coupled to the reference voltage input; and a level shifter having a positive supply voltage input, a negative load voltage input, and a positive error output coupled to the error input; and (b) a driver circuit having an input coupled to the positive supply voltage input, a control input coupled to the control output, and a drive output.

16. The circuit of claim 15 in which the level shifter includes a current source and a resistance coupled in series between the positive supply voltage input and the negative load voltage input.

17. The circuit of claim 15 in which the level shifter includes a current source and a resistor coupled in series between the positive supply voltage input and the negative load voltage input, the positive error output being coupled to between the current source and the resistor.

18. The circuit of claim 15 in which the level shifter includes a current source and a resistor coupled in series between the positive supply voltage input and the negative load voltage input, the positive error output being coupled to between the current source and the resistor, and the current source is coupled between the positive supply voltage input and the positive error output.

19. The circuit of claim 15 in which the regulation control circuit and the driver circuit are disposed on an integrated circuit substrate that is referenced to ground.

20. The circuit of claim 15 in which the driver includes a driver current source and a blocking transistor coupled in series between the positive supply voltage input and the drive output.

21. The circuit of claim 15 in which the driver includes a driver current source and a blocking transistor coupled in series between the positive supply voltage input and the drive output, and the driver current source includes a series coupled transistor and a resistor.

* * * * *